US007201565B2

(12) United States Patent
Ku et al.

(10) Patent No.: US 7,201,565 B2
(45) Date of Patent: Apr. 10, 2007

(54) FAN BLADE SET FOR COOLING FAN

(75) Inventors: Chin-Long Ku, Tu-Cheng (TW); Chin-Wen Yeh, Tu-Cheng (TW); Chuan-Chen Wang, Tu-Cheng (TW)

(73) Assignee: Hon Hai Precision Industry Co., Ltd. (TW)

( * ) Notice: Subject to any disclaimer, the term of this patent is extended or adjusted under 35 U.S.C. 154(b) by 171 days.

(21) Appl. No.: 11/019,344

(22) Filed: Dec. 21, 2004

(65) Prior Publication Data

US 2006/0008346 A1 Jan. 12, 2006

(30) Foreign Application Priority Data

Jul. 6, 2004 (CN) ..... 2004 1 0028016

(51) Int. Cl.
*F04D 13/12* (2006.01)

(52) U.S. Cl. ..... 416/175; 416/198 R

(58) Field of Classification Search ..... 415/143, 415/198.1, 199.3, 199.6; 416/175, 185, 198 R, 416/228

See application file for complete search history.

(56) References Cited

U.S. PATENT DOCUMENTS

| | | | | |
|---|---|---|---|---|
| 3,885,888 | A * | 5/1975 | Warhol | 416/175 |
| 426,263 | A * | 4/1980 | Goff | 415/224 |
| 6,065,936 | A * | 5/2000 | Shingai et al. | 416/175 |
| 6,948,912 | B2 * | 9/2005 | Chang et al. | 416/185 |
| 2002/0122724 | A1 | 9/2002 | Tseng | |

* cited by examiner

*Primary Examiner*—Edward K. Look
*Assistant Examiner*—Dwayne J White
(74) *Attorney, Agent, or Firm*—Morris Manning & Martin LLP; Tim Tingkang Xia, Esq.

(57) ABSTRACT

A fan blade set (10) for a cooling fan includes a hub (12) having a first wall and a second wall extending from the first wall. First blades (14) extend radially from the second wall. Second blades (16) formed on the first wall extend from a central portion of the first wall to a border thereof. Each second blade has a twisted shape such that an angle formed between the surface of the second blade and the first wall varies continuously along the extending direction of the second blade.

16 Claims, 1 Drawing Sheet

FAN BLADE SET FOR COOLING FAN

TECHNICAL FIELD

The present invention relates to a cooling fan, and particularly relates to a fan blade set for the cooling fan.

BACKGROUND

With continuing development of the electronic technology, electronic packages such as the CPUs are generating more and more heat that is required to be dissipated immediately.

Conventional cooling fans are commonly used for cooling computer CPUs and other industrial products. The cooling fan typically comprises a stator and a rotor being rotatable with respect to the stator. The rotor comprises a fan blade unit and a shaft extending downwardly from the fan blade unit. The stator comprises a bearing rotatably receiving the shaft. In order to improve cooling and heat dissipation efficiency, the most direct and effective way is to increase the amount of airflow. Increasing the amount of airflow can be achieved by different measures, for example, increasing the revolving speed of the fan blade set or changing the design of the fan blade set.

Increasing the revolving speed of the fan blade set relatively increases the amount of airflow, therefore the cooling and heat dissipation effective is relatively improved. However, increasing the revolving speed of the fan blade set causes the bearing to wear quickly. The heat produced due to friction between the shaft and the bearing causes the bearing to be damaged quickly, resulting in short service life of the cooling fan. Keeping the fan blade in balance is another important factor to be taken into account when wishing to increase the amount of airflow by increasing the revolving speed of the fan blade set. If the blades of the fan blade set are not arranged in balance, the blades will vibrate when starting the cooling fan, affecting the cooling fan quality and its service life. Therefore, it is not a good measure to increase the amount of airflow simply by increasing the revolving speed of the fan blade set. Further, increasing the revolving speed of the fan blade set also results in waste of power and increase of heat. Therefore, the best way to increase the amount of airflow is to change the design of the fan blade set.

SUMMARY OF THE INVENTION

The present invention is directed to a fan blade set for a cooling fan which produces a big amount of airflow.

A fan blade set for a cooling fan comprises a hub having a first wall and a peripheral wall extending from the first wall. First blades extend radially from the peripheral wall. Second blades formed on the first wall extend from a central portion of the first wall to a border thereof. Each second blade has a twisted shape such that an angle formed between the surface of the second blade and the first wall varies continuously along the extending direction of the second blade.

Other objects, advantages and novel features of the present invention will be drawn from the following detailed description of the preferred embodiments of the present invention with attached drawings, in which:

DETAILED DESCRIPTION OF PREFERRED EMBODIMENTS

Figure 1:
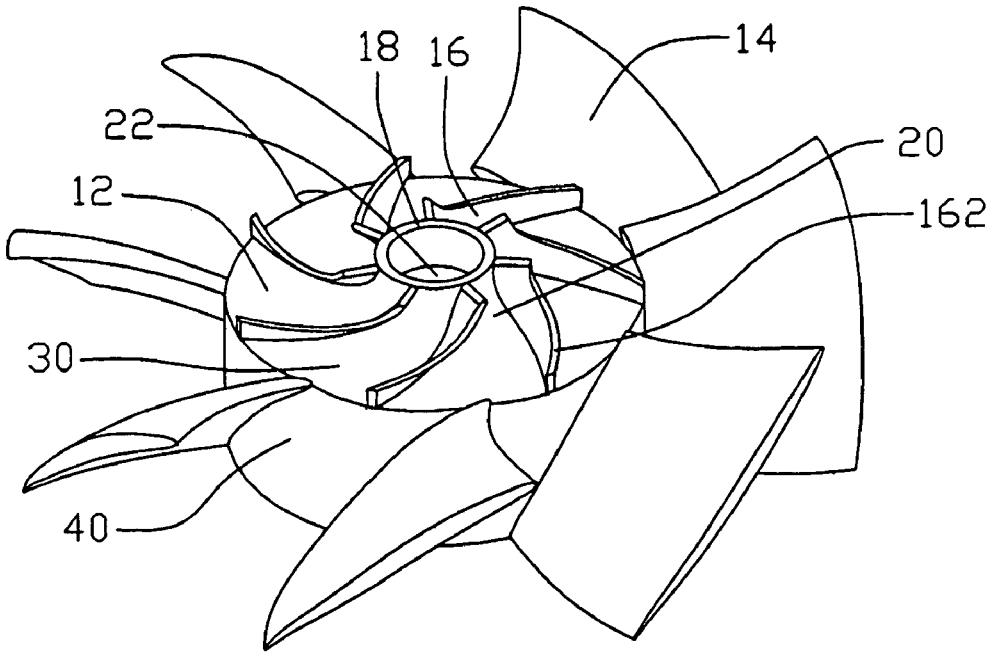
FIG. 1 is an isometric view of a fan blade set in accordance with a preferred embodiment of the present invention.
Figure 2:
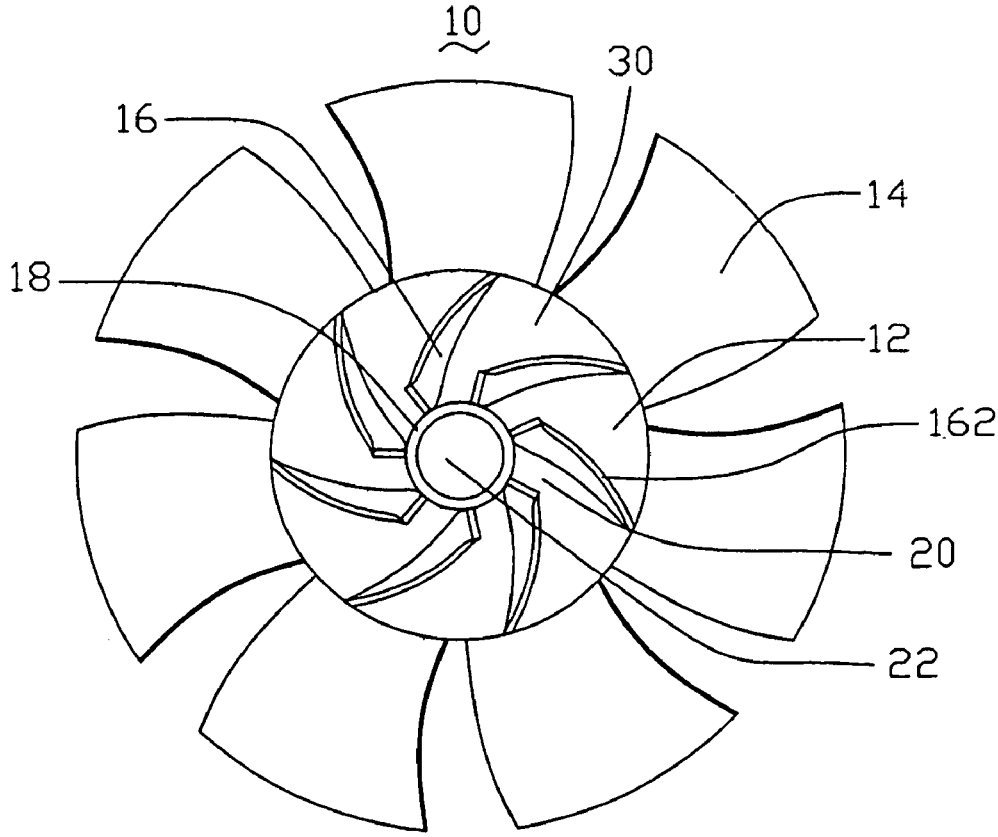
FIG. 2 is a top plan view of the fan blade set in FIG. 1.

Referring to FIGS. 1 and 2, a fan blade set of a cooling fan according to a preferred embodiment of the present invention comprises a hub 12, and a plurality of first and second blades 14, 16 arranged on and around the hub 12.

The hub 12 comprises a circular first wall 30 and a peripheral wall 40 extending downwardly from the border of the first wall 30. A generally cylindrical protrusion 18 extends upwardly from the central portion of the first wall 30. A hole 22 is defined in the center of the protrusion 18. Between the top face of the protrusion 18 and the first wall 30 forms an arched surface.

The first fan blades 14 are axial-flow blades that extend radially from the peripheral wall 40. The topmost portion of each first fan blade 14 is located beyond the first wall 30 in an axial direction of the fan blade set.

The second blades 16 are blower blades that arranged on the first wall 30. The second blades 16 extend from an outer periphery of the protrusion 18 to the border of the first wall 30. An air guide passage 20 is formed between two neighboring second blades 16.

Each second blade 16 has a twisted shape such that the angle formed by the surface of the second blade 16 and the first wall 30 varies continuously along the extending direction of the second blade 16 from an acute angle to a right angle. The distance between a top edge of each second fan blade 16 and the first wall 30 in an axial direction of the fan blade set decreases continuously along the extending direction of the second blade 16. In a top plan view of the fan blade set as shown in FIG. 2, each second fan blade 16 looks like a triangle.

During rotary motion of the fan blade unit, not only the first blades 14 continuously draw air currents from above the first blades 14 to produce axial airflow, but also the second blades 16 continuously draw air currents from above the second blades 16 and then to the first blades 14, enabling the first blades 14 to send out the air current. By means of the action of the second blades 16 and the first blades 14, a big amount of airflow is produced to achieve a high cooling and heat dissipation effect without producing much noise and heat. Each second blade 16 has a twisted shape, thereby reducing the resistance to the airflow and thus increasing the amount of the airflow.

It is understood that the invention may be embodied in other forms without departing from the spirit thereof. The above-described examples and embodiments are to be considered in all respects as illustrative and not restrictive, and the invention is not to be limited to the details given above.

What is claimed is:

1. A fan blade set for a cooling fan comprising:

a hub having a first wall and a second wall extending from the first wall in an axial direction of the hub;

a plurality of first blades extending radially from the second wall; and a plurality of second blades extending from and being inclined with respect to the first wall for driving air neighboring the first wall of the hub to the first blades;

wherein a generally cylindrical protrusion is formed on a central portion of the first wall, and the second blades extend from an outer periphery of the protrusion, and wherein an arched surface is formed between the top face of the protrusion and the first wall.

2. The fan blade set for a cooling fan as described in claim 1, wherein each of the second blades extends from the central portion of the first wall to a border portion thereof, and has a twisted shaped such that an angle formed between the second blade and the first wall varies continuously from the central portion to the border portion.

3. The fan blade set for a cooling fan as described in claim 2, wherein the angle formed near the central portion of the first wall is an acute angle and the angle formed at the border portion of the first wall is a right angle.

4. The fan blade set for a cooling fan as described in claim 2, wherein the distance between a distal edge of each second fan blade and the first wall in the axial direction of the hub increases continuously from the border portion to the central portion.

5. The fan blade set for a cooling fan as described in claim 1, wherein a hole is defined in the center of the protrusion.

6. The fan blade set for a cooling fan as described in claim 1, wherein each first fan blade is located at a side of the first wall opposing to every of the second fan blades.

7. A cooling fan comprising a fan blade set, the fan blade set comprising:

a hub having a first wall and a peripheral wall depending from the first wall;

a plurality of axial-flow blades arranged around the hub for producing an axial airflow, the axial-flow blades extending radially from the peripheral wall; and a plurality of blower blades arranged on the hub for driving air aligned with the hub to the axial-flow blades, the blower blades being formed on the first wall and extending from a central portion to a border of the first wall, each of the blower blades having a twisted shape such that an angle formed by the surface of the blower blade and the first wall increases continuously along the extending direction of the blower blade.

8. The cooling fan as described in claim 7, wherein the angle formed near the central portion of the first wall is an acute angle and the angle formed at the border of the first wall is a right angle.

9. The cooling fan as described in claim 7, wherein the distance between a top edge of each blower blade and the first wall in an axial direction of the fan blade set decreases continuously along the extending direction of the blower blade.

10. The cooling fan as described in claim 7, wherein a generally cylindrical protrusion is formed on the central portion of the first wall, and the blower blades extend from an outer periphery of the protrusion.

11. The cooling fan as described in claim 10, wherein between the top face of the protrusion and the first wall forms an arched surface.

12. The cooling fan as described in claim 7, wherein the topmost portion of each axial-flow blade is located beyond the first wall in an axial direction of the fan blade set.

13. A fan blade set for a cooling fan comprising:

a hub having a first wall and a second wall extending from the first wall;

a plurality of first blades extending radially from the second wall; and a plurality of second blades formed on the first wall and extending from a central portion of the first wall to a border thereof, every two neighboring second blades forming an air passage for guiding air above the second blades to the first blades, the distance between a top edge of each second fan blade and the first wall in an axial direction of the fan blade set decreasing continuously along the extending direction of the second blade.

14. The fan blade set as described in claim 13, wherein each of the second blades has a twisted shape such that an angle formed between the surface of the second blade and the first wall increases continuously along the extending direction of the second blade, the angle formed near the central portion of the first wall is an acute angle and the angle formed at the border of the first wall is a right angle.

15. The fan blade set as described in claim 13, wherein a generally cylindrical protrusion is formed on the central portion of the first wall, and the second blades extend from an outer periphery of the protrusion.

16. The fan blade set as described in claim 15, wherein between the top face of the protrusion and the first wall forms an arched surface.

* * * * *